United States Patent [19]

Lund

[11] 4,161,147

[45] Jul. 17, 1979

[54] LOOPER MECHANISM FOR A TUFTING MACHINE

[75] Inventor: Kenneth Lund, Accrington, England

[73] Assignee: Edgar Pickering (Blackburn) Limited, Blackburn, England

[21] Appl. No.: 885,165

[22] Filed: Mar. 10, 1978

[51] Int. Cl.[2] ..... D05C 15/22

[52] U.S. Cl. ..... 112/79 R

[58] Field of Search ..... 112/79 R, 79 A, 266, 112/410, 411

[56] References Cited

U.S. PATENT DOCUMENTS

| | | | |
|---|---|---|---|
| 3,595,184 | 7/1971 | Watkins | 112/79 R |
| 3,780,678 | 12/1973 | Short | 112/79 A |
| 3,878,800 | 4/1975 | Collier et al. | 112/79 R |
| 3,913,505 | 10/1975 | Crumbliss et al. | 112/79 R |

*Primary Examiner*—H. Hampton Hunter

*Attorney, Agent, or Firm*—Watson, Cole, Grindle & Watson

[57] ABSTRACT

A looper mechanism for a tufting machine for producing loop pile fabric, comprising a looper bar carrying loopers which cooperate with respective needles of the machine and means for oscillating the looper bar to effect such cooperation, the looper bar having, in the side thereof facing the needles, a plurality of slots each of which accommodates, side by side, shank portions of a pair of loopers having hook portions facing the needles, the hook portion of one looper of the pair being coplanar with its shank portion and the hook portion of the other looper being offset from its shank portion by an amount equal to the spacing between the needles, and each pair of loopers being retained in its respective slot by a single clamping screw.

2 Claims, 4 Drawing Figures

LOOPER MECHANISM FOR A TUFTING MACHINE

A tufting machine for producing loop pile fabric includes a series of loopers, one for each needle, which are retained by clamping screws in slots in a looper bar which is periodically oscillated to cause the loopers to catch and release the loops of yarn projected by the needles through the backing fabric.

Difficulty arises in mounting the loopers in the looper bar in a fine gauge machine, e.g. one in which the needles are spaced by a distance as small as 1/16".

The invention provides a looper mechanism for a tufting machine for producing loop pile fabric, comprising a looper bar carrying loopers which cooperate with respective needles of the machine and means for oscillating the looper bar to effect such cooperation, the looper bar having, in the side therepf facing the needles, a plurality of slots each of which accommodates, side by side, shank portions of a pair of loopers having hook portions facing the needles, the hook portion of one looper of the pair being coplanar with its shank portion and the hook portion of the other looper being offset from its shank portion by an amount equal to the spacing between the needles, and each pair of loopers being retained in its respective slot by a single clamping screw.

Figure 1:
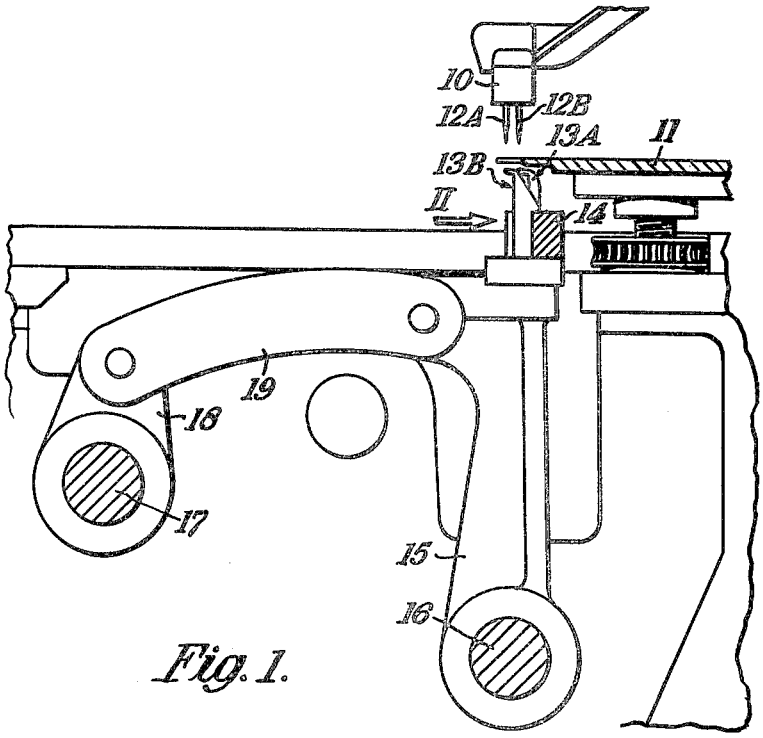
Figure 2:
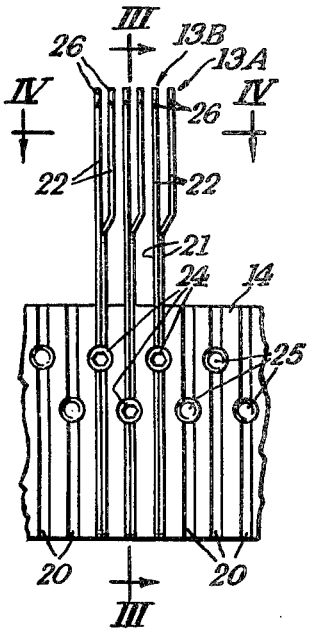
Figure 3:
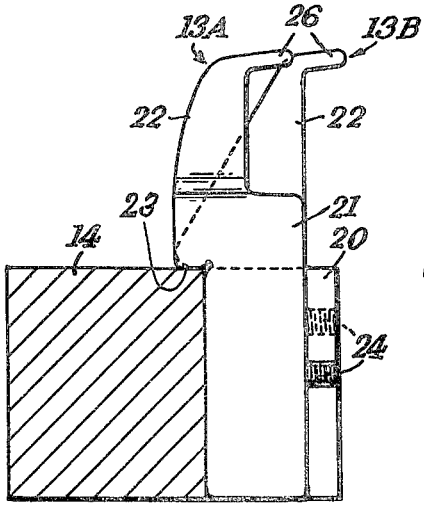
Figure 4:
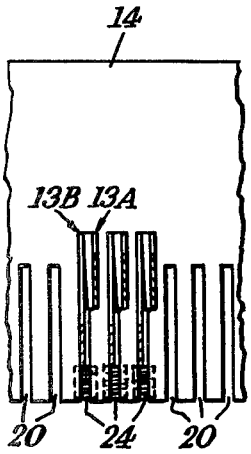

One embodiment of the invention is illustrated, by way of example, in the accompanying diagrammatic drawing, in which FIG. 1 is a cross section showing the looper mechanism, FIG. 2 is a side view, on a larger scale of part of the looper bar, FIG. 3 is a section on the line III—III in FIG. 2, and FIG. 4 is a section on the line IV—IV in FIG. 2.

The tufting machine, of which part is shown in FIG. 1, includes a needle bar 10, which is reciprocated vertically in the conventional manner to cause needles carried by the bar to project loops of yarn through a backing fabric (not shown) which is advanced from right to left along a needle plate 11.

The needle bar carries two rows of needles 12A, 12B, the needles in each row being equally spaced with the needles 12A disposed midway between the needles 12B. The loops of yarn projected through the backing fabric are caught by loopers 13A, 13B allocated respectively to the needles 11A, 11B which are mounted, as described below, in a looper bar 14. The bar 14 is mounted by a series of arms 15 on a shaft 16 and is oscillated by an oscillating shaft 17, through the agency of arms 18 on the shaft 17 and links 19 connecting the arms 18 and 15.

The looper bar 14 has, in the side facing the needles, a series of equally spaced slots 20. Each of the loopers 13A. 13B has a shank portion 21 and a hook portion 22. The hook portions 22 of the loopers 13B are coplanar with their shank portions 21 but, as shown most clearly in FIG. 2, the hook portions 22 of the loopers 13A are offset from their shank portions 21 by an amount equal to the machine gauge, i.e. the spacing between the needles. In the case of the staggered needle bar shown, this spacing is the distance between a needle 12A in one row and an adjoining needle 12B in the other row.

The shank portions 21 of a looper 13A and a looper 13B are accommodated side by side in each slot 20 in the looper bar 14, and all loopers have locating shoulders 23 which abut against the upper surface of the looper bar 14 as shown in FIG. 3. The loopers, thus accommodated in pairs in the slots 20, are retained in position by clamping screws 24, screwed into tapped holes 25 in the bar 14. As shown in FIG. 2, the holes 25 are disposed in two superposed rows, and the screws 24 in the upper and lower rows clamp the loopers in alternate slots 20.

As most clearly shown in FIG. 3, the bills 26 of the loopers 13B project from the bar 14 to a greater extent than the bills 26 on the loopers 13A, so that the loopers 13B may cooperate, upon oscillation of the bar 14, with the needles 12B and the loopers 13A with the needles 12A.

When the needle bar of the tufting machine has a single row of needles only, the loopers will be modified in shape from the construction shown to the extent only that the bills 26 of all loopers will project to the same extent from the bar 14.

What I claim as my invention and desire to secure by Letters Patent is:

1. In a tufting machine for producing loop pile fabric, and having a vertically reciprocable needle bar carrying a plurality of needles, a looper mechanism comprising a looper bar carrying loopers each of which cooperates with a respective individual needle on the needle bar, each looper having a lower shank portion, a single upper hook portion for engaging loops of yarn formed by the needle cooperating with said looper and a shoulder intermediate said shank portion and said hook portion, means for oscillating the looper bar to effect cooperation between said loopers and said needles, the looper bar having, in a side thereof facing the needles, a plurality of slots each of which accommodates, side-by-side, each shank portion of a pair of loopers with each hook portion thereof facing the needles and each shoulder thereof abutting an upper surface of the looper bar to position each said hook portion at the same level above the looper bar, the hook portion of one looper of the pair being coplanar with its shank portion and the hook portion of the other looper being offset from its shank portion by an amount equal to the spacing between the needles, and a plurality of clamping screws, each of which retains said pair of loopers in said slots in said looper bar.

2. A looper mechanism according to claim 1, in which the clamping screws engage tapped holes disposed in two rows in the looper bar, the screws in each row of holes engaging alternate pairs of loopers.

* * * * *